United States Patent [19]

Rueggeberg

[11] 4,160,145

[45] Jul. 3, 1979

[54] MICROWAVE APPLICATOR DEVICE

[75] Inventor: Werner Rueggeberg, Lancaster, Pa.

[73] Assignee: Armstrong Cork Company, Lancaster, Pa.

[21] Appl. No.: 878,285

[22] Filed: Feb. 16, 1978

[51] Int. Cl.[2] ..... H05B 9/06

[52] U.S. Cl. ..... 219/10.55 F; 219/10.55 A

[58] Field of Search ..... 219/10.55 F, 10.55 A, 219/10.55 R; 333/95 S, 95 R

[56] References Cited

U.S. PATENT DOCUMENTS

| | | | |
|---|---|---|---|
| 2,704,802 | 3/1955 | Blass et al. | 219/10.55 F |
| 3,581,038 | 5/1971 | Williams | 219/10.55 F |
| 3,622,732 | 11/1971 | Williams | 219/10.55 F |
| 3,632,945 | 1/1972 | Johnson | 219/10.55 F |
| 3,705,283 | 12/1972 | Sayer | 219/10.55 F |
| 3,764,768 | 10/1973 | Sayer, Jr. | 219/10.55 F |
| 3,783,221 | 1/1974 | Soulier | 219/10.55 F |
| 4,019,009 | 4/1977 | Kusunoki et al. | 219/10.55 F |

FOREIGN PATENT DOCUMENTS

| | | | |
|---|---|---|---|
| 219172 | 1/1962 | Austria | 219/10.55 E |

*Primary Examiner*—Arthur T. Grimley

[57] ABSTRACT

A microwave applicator for uniform or profiled heating of materials with microwave energy. A hollow rectangular waveguide is provided with an array of resonant slots communicating through the wall of the waveguide. The slots are spaced out from the center line of the wall by varying amounts in order to selectively couple energy out of the waveguide. The slots are provided in pairs, individual slots and slot pairs being longitudinally separated by multiples of three-quarters waveguide wavelength distance to improve the efficiency of energy coupling out of the waveguide.

8 Claims, 5 Drawing Figures

MICROWAVE APPLICATOR DEVICE

BACKGROUND OF THE INVENTION

The present invention relates to microwave antennas and, more particularly, to microwave radiators for uniformly applying microwave energy to material conveyed past the radiator.

Heretofore, microwave applicators have been proposed which employ a broadside antenna to direct microwave energy onto material to be treated. Some such applicators have been complex structures comprising multiple waveguide radiative elements excited by loop coupling from a coaxial line. In addition to being expensive, these structures have been limited in power to the maximum power capability of the coaxial feed line, and, in use, these devices have encountered problems with energy reflection back to the antenna. Other applicators, e.g., U.S. Pat. No. 3,622,732 to Williams, have employed conductive enclosures such as multi-mode cavity resonators fed with microwave energy at spatially separated feed points to treat materials passed through the resonators. However, these devices have proven ineffective in providing uniform treatment of lossy materials because the energy distribution within the resonator becomes nonuniform when the material is introduced into the cavity, and difficulties have arisen with varying loads pulling the frequency of oscillation of the microwave tube causing high power reflections and poor efficiencies. Still other microwave applicators, e.g., U.S. Pat. No. 3,764,768 to Sayer, have employed an array of shunt slots one-half wavelength apart centrally communicating through one side of a rectangular waveguide, individual slots being provided with a slot loading member adjustable to vary the power coupled out through the slot and thereby affect a uniform output from the applicator along the length of the waveguide. However, this device has been found subject to the serious disadvantage that the slot spacing arrangements and slot loading members create impedance mismatches and cause energy reflections which result in power coupling inefficiencies.

SUMMARY OF THE INVENTION

A principle object of the present invention is to provide a microwave radiator which can uniformly apply microwave energy to a material being conveyed past the radiator.

Another object of the present invention is to provide a microwave applicator in which energy reflections are minimized and high power coupling efficiencies are achieved.

A further object of the present invention is to provide a microwave applicator of simple, inexpensive, and durable design, otherwise well adapted for the purposes for which the same is intended.

Accordingly, the present invention provides a rectangular waveguide having an array of one-half free space wavelength longitudinal resonant shunt slots communicating through the wall of the waveguide. The slots are positioned in pairs along the length of the waveguide and are spaced progressively further out from the center line of the waveguide in the direction away from the microwave energy source. The progressive distancing of the slots away from the center line of the wall may be so adjusted to provide equal coupling of energy out of the waveguide along its length. The individual slots of each slot pair are longitudinally placed odd multiples of three-quarters waveguide wavelength distance apart. The slot pairs are also positioned odd multiples of three-quarter waveguide wavelength distance apart. The spacing of the slots and the slot pairs minimizes energy reflections in the waveguide and increases the efficiency of the apparatus by reducing the standing wave ratio in the waveguide.

DESCRIPTION OF THE PREFERRED EMBODIMENT

Figure 1:
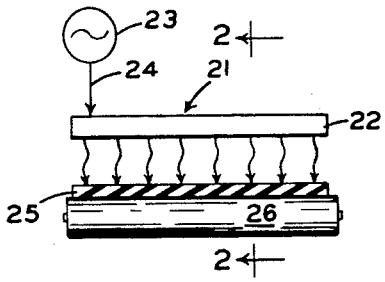
FIG. 1 is a schematic transverse view of a microwave applicator employing features of the present invention.
Figure 2:
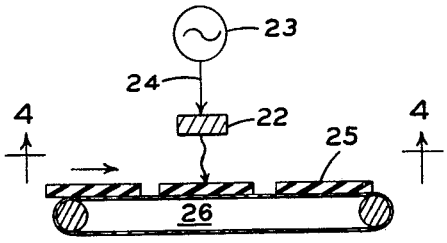
FIG. 2 is a sectional view of the structure of FIG. 1 taken along line 2—2 in the direction of the arrows.

Referring now to the figures wherein like reference characters refer to like or corresponding parts throughout the several views, FIGS. 1 and 2 show a microwave applicator 21 including a slotted microwave radiator 22 supplied with microwave energy via a waveguide or suitable transmission line 24 from a microwave generator 23. If the plane of the waveguide wall containing the radiating slots is parallel to the plane of the work load, the microwave radiator is preferentially positioned several wavelengths above material 25. In this configuration, the waveguide comprises a broadside slot radiative antenna which is constructed to direct semi-randomly phases microwave energy at material 25 intended to be treated with microwave energy while conveyed past the radiator on and by mechanism 26. If the plane of the waveguide wall containing the radiating slots is perpendicular to the surface of the work load, the radiator may be brought as close to the material 25 as conditions permit. For the latter case, the microwave energy transfer properties are changed through proximity effect and by direction, polarization, of the fields with respect to the surface of the work load 25. Microwave generator 23 may be a microwave tube such as a klystron or magnetron operating at 2450 megahertz or any suitable frequency. Waveguide 24 may be coupled to the radiative antenna by flanged connections or any other conventional coupling. The radiator 22 is preferentially end fed although center feeding to matched side radiators may be arranged by those skilled in the arts of microwave technology.

Figure 3:
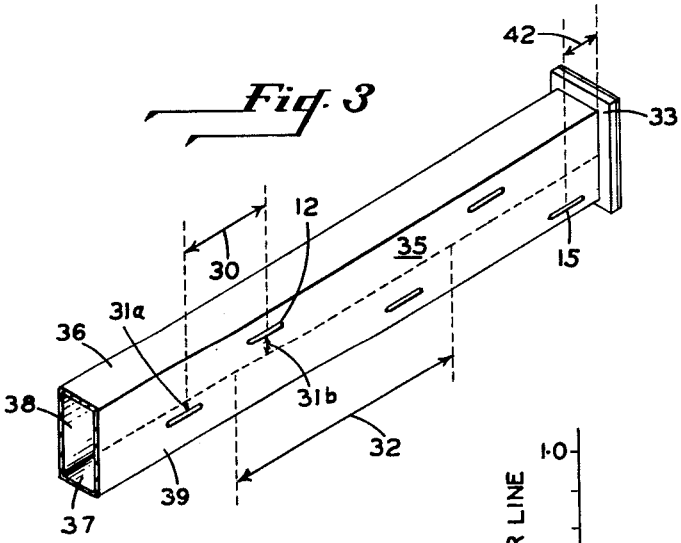
FIG. 3 is an enlarged perspective view, broken away, of the radiator of FIG. 1.
Figure 4:
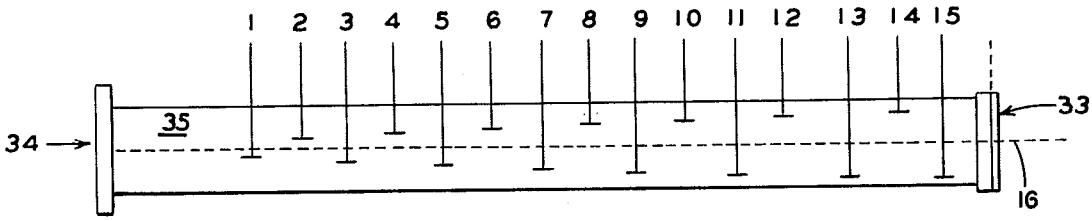
FIG. 4 is a view of the structure of FIG. 2 taken along line 4—4 in the direction of the arrows.

Referring now to FIGS. 3 and 4, radiative antenna 22 includes a hollow waveguide section 35 comprising sidewalls 36 and 37 and broadwalls 38 and 39. The waveguide section 35 is terminated at one end by a shorting plate 33 which, through the cooperative presence of the singular, specially located slot 15, provides a perfect termination for residual energy arriving from the preceding slot pair. At its other end the waveguide section 35 is provided with a coupling plate 34 whereby the radiator 22 may be connected to its source of microwave energy. The waveguide section 35 is preferably dimensioned to be no higher, from broadwall to broadwall, than one-half free space wavelength of the microwave excitation frequency and no more or less wide, from sidewall to sidewall, than from one to one-half free space wavelength of the same frequency. With the dimensions set forth above, the waveguide will operate in the $TE_{10}$ mode, all other modes being suppressed, and the electric field in the waveguide will achieve a sinusoidal maximum at the transverse center of the broadwalls. Other dimensions for the waveguide section 35 resulting in other field modes in the waveguide may be used. However, the dimensions specifically related lead directly to the intended and most efficient operation of the present invention.

Slots 1–15 are longitudinally oriented relative to the radiator 22 and are of uniform size, being one-half free space wavelength long between extremes of the full radius ends and approximately one-quarter inch wide. Slots 1–14 are grouped in pairs and positioned progressively outward from the center line 16 of the broadwall 39 in the direction away from the input end of the radiator 22. For the $TE_{10}$ mode of operation, the electric currents transversely oriented to the major axes of the slots increase from a negligible value at the center line of the broadwalls to maximum values at the broadwall edges. The positioning of the slots 1–4 progressively farther out from the center line 16 of the broadwall 39 leads to progressively greater interruption of these currents which, in turn, leads to the coupling of progressively greater percentages of the microwave energy in the waveguide out of succeeding slots down the length of the radiator 22. For particular radiator waveguides formulas may be empirically determined which express the amount of released power in terms of displacements of slot pairs off center line of the waveguide.

For a radiator 22 having a WR340 waveguide operating in the $TE_{10}$ mode it has been determined that the relationships between the amounts of released power, in terms of decibels reduction of power inside the waveguide section 35 after propagation past a pair of radiating slots, and the slot displacements off the center line may be expressed as follows:

$$(1)\ X_1 = 0.588 \tan^{-1} [0.659\sqrt{Db}] \text{ inches} \pm 0.001 \text{ inch}$$

$$(2)\ X_2 = 1.078 \tan^{-1} [0.433\sqrt{Db}] \text{ inches} \pm 0.001 \text{ inch}$$

where $X_1$ = displacement of the leading slot (toward the input end) off the center line of the waveguide; $X_2$ = displacement of the trailing slot off the center line of the waveguide; $Db = 10 \log$ (Power input/Power output); and the tolerances specified insure performance within 10% of expected values. Note that Power input refers to power approaching a slot pair inside the waveguide and that Power output refers to power leaving a slot pair inside the waveguide. Formulas 1 and 2 are also applicable to waveguide radiators operating at 2450 megahertz and utilizing waveguides other than WR340 waveguides when the area of the interior cross section of the non-WR340 waveguide is equal to the area of the interior cross section of a WR340 waveguide and when, in addition, the product of the square of the broadwall to broadwall distance multiplied by waveguide wavelength for the non-WR340 waveguide is equal to the same product determined with respect to a standard WR340 waveguide.

Figure 5:
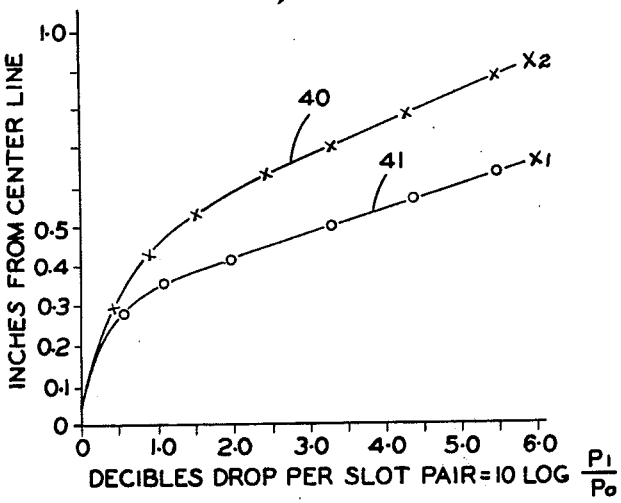
FIG. 5 is a plot of the decibels drop per slot pair versus the distances from the broadwall center line of the slot centers.

The foregoing formulas are graphically illustrated in FIG. 5; curve 41 corresponding to solutions of formula 1 and curve 40 corresponding to solutions of formula 2. The formulas can be used in conjunction with knowledge of the total power input to the waveguide to determine the necessary displacements 31*a* and 31*b* of succeeding slot pairs off the center line of the broadwalls to affect any distribution desired of microwave energy output along the length of the radiator 22. Similar formulas may be determined for other types of radiator waveguides. In all cases terminal slot 15, in conjunction with end plate 33, is selectively placed at the edge of the broadwall 39 at the terminal end of the waveguide section to couple all remaining energy out of the waveguide.

The centers of slots of individual slot pairs are preferably spaced odd multiples of three-quarter waveguide wavelength distance 30 apart. Furthermore, adjacent slot pairs are also preferably centered odd multiples of three-quarter waveguide wavelength distance 32 apart. The foregoing longitudinal positioning of the slots along the length of the broadwall 39 results in the cancelling of undesirable power reflections in the waveguide section 35. The terminal slot 15 is preferentially positioned between one-quarter and one-half waveguide wavelength distance 42 from the shorting plate 33 to provide a low reflection termination. For the case of WR340 waveguide, this distance was experimentally determined to be 2.370 inches. The low level of power reflection in the waveguide section 35 provides a low voltage standing wave ratio at the input 34 to the radiator and leads to high power transfer efficiencies in the applicator system.

Referring now specifically to FIG. 4, the foregoing design principles may be manifested in a specific design for the case where a radiator comprising a WR340 waveguide section dimensioned on the interior 3.400" wide and 1.700" across is driven by a 30 kilowatt, 2450 megahertz source, and it is desired to achieve as uniform as possible a release of energy over a linear distance of seven feet, as follows:

Seven slot pairs and a terminating slot (all slots 2.40×0.25 in.) are spaced along one broadwall of the waveguide section so that each slot and each slot pair are 5.17 inches, ¾ waveguide wavelength, apart. The terminating slot 15 is spaced 2.37 inches from the shorting plate 33, as noted previously. By using 15 slots spaced as described, power reflections are minimized while output is provided over a seven foot range. To achieve linearly uniform output, the microwave power level must drop 4 kilowatts as each slot pair is passed from input to termination, leaving 2 kilowatts as the residual output for the termination slot. Starting with 30 kilowatts and calculating the necessary reduction in power at each successive slot pair in terms of decibels and substituting in formulas 1 and 2, the transverse position of the center of each slot off the center line of the wall is determined. Table I lists the values of the waveguide power, decibel power drop, and slot distances off center line for a 15 slot, 30 kilowatt, uniform power WR340 waveguide radiator:

Table I

Electrical and Dimensional Values Used for the Design of a 30 KW Slotted Radiator with Uniform Energy Distribution

| Slot Pair | Waveguide Power Incident | Waveguide Power Transmitted | DB Power Drop | Slot Location Off Center Line | |
|---|---|---|---|---|---|
| 1 and 2 | 30 KW | 26 KW | 0.62 | 0.29 in. | 0.36 in. |
| 3 and 4 | 26 | 22 | 0.73 | 0.31 | 0.38 |
| 5 and 6 | 22 | 18 | 0.88 | 0.33 | 0.42 |
| 7 and 8 | 18 | 14 | 1.10 | 0.36 | 0.46 |
| 9 and 10 | 14 | 10 | 1.48 | 0.39 | 0.52 |
| 11 and 12 | 10 | 6 | 2.22 | 0.43 | 0.61 |
| 13 and 14 | 6 | 2 | 4.78 | 0.58 | 0.82 |

Table I-continued

Electrical and Dimensional Values Used for the Design of a 30 KW Slotted Radiator with Uniform Energy Distribution

| Slot Pair | Waveguide Power Incident | Waveguide Power Transmitted | DB Power Drop | Slot Location Off Center Line |
|---|---|---|---|---|
| 15 | 2.0 | 0 | — | at edge |

In operation, radiators of this design may provide linearly uniform output power with an average variation from average power of approximately 8% for all slot pairs and a voltage standing wave ratio of between 1.10 and 1.20 at the input to the total waveguide section. With the current design, it is believed possible to achieve a VSWR of near to 1.00 for idealized conditions; however, machining errors and materials imperfections prevent this ideal from being achieved.

Alternatively, if it is desired to treat materials passing on opposite sides of a radiator slot, slot pairs may be provided on both broadwalls of the waveguide section. In this fashion controlled output may be simultaneously furnished on opposite sides of a radiator. The same design principles may be employed in constructing radiators having output from both broadwalls as are employed in constructing radiators having output from a single broadwall. One must realize, however, that the design curves are so adjusted that only one slot pair may exist within a given waveguide section. Such a single slot pair may be placed on either broadside of the radiating guide at exactly the identical longitudinal location along the length of the line.

If it is desired to construct a radiator having nonuniform or graded output of microwave energy, formulas 1 and 2 may be used to determine the transverse position of the shunt slots along the waveguides such that any distribution of microwave energy is provided. Any radiated energy profile may be provided to produce an optimum energy distribution as may be required in a particular application to obtain uniform, nonuniform, or graded heating, drying, or treating of material to be processed.

Although longitudinal slots only have been discussed, certain of the above related principles are equally valid for transverse slots, perpendicular to the center line of the broad face of the waveguide, and to oblique slots that may be positioned at any angle within the 90° range separating transverse from longitudinal slots. Mixed combinations of slot pairs may be usefully employed as well as mixed slots within a pair. The choice may be determined by the power to be extracted from the incident wave and by the direction, polarization, of the fields with respect to the heating load. Preferential polarizations may exist related uniquely to particular applications.

Since many changes could be made in the above construction and many apparently widely different embodiments of this invention could be made without departing from the scope thereof, it is intended that all matter contained in the above description or shown in the accompanying drawings shall be interpreted as illustrative and not in a limiting sense.

What is claimed is:

1. In a microwave applicator including a rectangular waveguide section having a plurality of resonant slot means communicating through one of the broadwalls of the waveguide for coupling microwave energy out of the waveguide, the improvement which comprises:

positioning the centers of said slot means outward from the longitudinal center line of said broadwall by varying distances in order to provide for the coupling of varying amounts of energy through said slot means out of said waveguide.

2. The microwave applicator of claim 1, wherein said waveguide section is a standard WR340 waveguide; said slot means are longitudinally oriented, are grouped in pairs, and are one-half free space wavelength long; and the centers of said slot means are positioned transversely outward from the center line of said broadwall according to the following formulas:

$$X_1 = 0.588 \tan^{-1} [0.659\sqrt{Db}] \pm 0.001 \text{ inch}$$

$$X_2 = 1.078 \tan^{-1} [0.433\sqrt{Db}] \pm 0.001 \text{ inch;}$$

where $X_1$ = distance, in inches, off center line of first slot, $X_2$ = distance, in inches, off center line of second slot, $$Db = 10 \log \frac{\text{Internal waveguide power approaching a slot pair}}{\text{Internal waveguide power leaving a slot pair}}$$

and the difference between the power input and power output in the waveguide is constant for all slot pairs;

whereby a uniform power output is provided along the length of said waveguide section.

3. The microwave applicator of claim 1, wherein said waveguide section is so dimensioned such that the area of the interior cross section of said waveguide section is equal to the area of the interior cross section of a WR340 waveguide, and the product of the square of the broadwall to broadwall distance multiplied by the waveguide wavelength for said waveguide section is equal to the same product computed with respect to a standard WR340 waveguide; said slot means are longitudinally oriented, are grouped in pairs, and are one-half free space wavelength long; and the centers of said slot means are positioned outward from the center line of said broadwall according to the following formulas:

$$X_1 = 0.588 \tan^{-1} [0.659\sqrt{Db}] \pm 0.001 \text{ inch}$$

$$X_2 = 1.078 \tan^{-1} [0.433\sqrt{Db}] \pm 0.001 \text{ inch;}$$

where $X_1$ = distance, in inches, off center line of first slot, $X_2$ = distance, in inches, off center line of second slot, $$Db = 10 \log \frac{\text{Internal waveguide power approaching a slot pair}}{\text{Internal waveguide power leaving a slot pair}}$$

and the difference between the power input and power output in the waveguide is constant for all slot pairs;

whereby a uniform power output is provided along the length of said waveguide section.

4. In a microwave applicator including a rectangular waveguide section having a plurality of one-half free space wavelength long longitudinal slot means grouped in pairs communicating through one of the broadwalls of the waveguide for coupling microwave energy out of the waveguide, the improvement which comprises:

longitudinally positioning the centers of individual slot means in slot means pairs integral multiples three-quarters waveguide wavelength distance apart, and longitudinally centering slot means pairs three-quarters waveguide wavelength distance apart;

whereby reflections in the waveguide section are minimized and efficient power coupling out of the applicator is promoted.

5. The microwave applicator of claim 4 wherein the centers of said slot means are positioned transversely outward from the longitudinal center lines of said broadwall by varying distances in order to provide for coupling of varying amounts of energy through said slot means out of said waveguide.

6. The microwave applicator of claim 5 wherein said waveguide section is a standard WR340 waveguide and said slot means pairs are positioned outward from the center lines of said broadwall according to the following formulas:

$$X_1 = 0.558 \tan^{-1} [0.659\sqrt{Db}] \pm 0.01 \text{ inch}$$

$$X_2 = 1.078 \tan^{-1} [0.433\sqrt{Db}] \pm 0.01 \text{ inch;}$$

where $X_1$=distance, in inches, off center line of first slot $X_2$=distance, in inches, off center line of second slot $$Db = 10 \log \frac{\text{Internal waveguide power approaching a slot pair}}{\text{Internal waveguide power leaving a slot pair}}$$

and the difference between the power input and the power output in the waveguide is constant for all slot means pairs;

whereby a uniform power output is provided along the length of the waveguide section.

7. In a microwave applicator which includes a standard WR340 waveguide section having longitudinally oriented one-half waveguide wavelength long slot means communicating through one or more of the broadwalls of said waveguide for coupling microwave energy out of the waveguide, the improvement which comprises:

grouping adjacent slot means on the same broadwall into pairs wherein individual slot means within said pairs are longitudinally separated by an integral multiple of three-quarters waveguide wavelength distance, and longitudinally positioning said pairs of slot means located on one or more of said broadwalls so that all said pairs are longitudinally separated by an integral multiple of three-quarters waveguide wavelength distance;

whereby reflections in the waveguide section are minimized and efficient power coupling out of the applicator is promoted.

8. The applicator of claim 7, wherein said pairs of slot means are positioned transversely outward from the center lines of said broadwalls according to the following formulas:

$$X_1 = 0.558 \tan^{-1} [0.659\sqrt{Db}] \pm 0.001 \text{ inch}$$

$$X_2 = 1.078 \tan^{-1} [0.433\sqrt{Db}] \pm 0.001 \text{ inch;}$$

where $X_1$=distance, in inches, off center line of first slot $X_2$=distance, in inches, off center line of second slot $$Db = 10 \log \frac{\text{Internal waveguide power approaching a slot pair}}{\text{Internal waveguide power leaving a slot pair}}$$

and the difference between the power input and the power output in the waveguide is constant for all slot means pairs;

whereby a uniform power output is provided along the length of the waveguide section.

* * * * *